US009913524B2

(12) United States Patent
Maurin et al.

(10) Patent No.: US 9,913,524 B2
(45) Date of Patent: Mar. 13, 2018

(54) GEL COSMETIC APPLICATOR

(71) Applicant: HCT Group Holdings Limited, Central (HK)

(72) Inventors: Denis Pierre Maurin, Los Angeles, CA (US); Nicholas Gardner, Los Angeles, CA (US); Armando Villarreal, Los Angeles, CA (US)

(73) Assignee: HCT Group Holdings Limited, Hong Kong (HK)

( * ) Notice: Subject to any disclaimer, the term of this patent is extended or adjusted under 35 U.S.C. 154(b) by 56 days.

(21) Appl. No.: 14/624,178

(22) Filed: Feb. 17, 2015

(65) Prior Publication Data

US 2015/0257511 A1 Sep. 17, 2015

Related U.S. Application Data

(60) Provisional application No. 61/944,521, filed on Feb. 25, 2014.

(51) Int. Cl.
*A45D 34/04* (2006.01)
*A45D 40/26* (2006.01)

(52) U.S. Cl.
CPC ..... *A45D 40/262* (2013.01); *A45D 34/04* (2013.01); *A45D 34/042* (2013.01); *A45D 40/26* (2013.01); *A45D 2200/1009* (2013.01)

(58) Field of Classification Search
CPC ..... A45D 34/04
USPC ..... 401/261–266; 15/207.2, 244.1
See application file for complete search history.

(56) References Cited

U.S. PATENT DOCUMENTS

| | | | |
|---|---|---|---|
| 3,485,787 | A | 12/1969 | Haefele et al. |
| 3,676,387 | A | 7/1972 | Lindlof |
| 3,827,999 | A | 8/1974 | Crossland |
| 4,176,240 | A | 11/1979 | Sabia |
| 4,259,540 | A | 3/1981 | Sabia |
| 4,351,913 | A | 9/1982 | Patel |
| 4,369,284 | A | 1/1983 | Chen |
| 4,404,296 | A | 9/1983 | Schapel |
| 4,432,607 | A | 2/1984 | Levy |
| 4,456,642 | A | 6/1984 | Burgdorfer et al. |
| 4,492,428 | A | 1/1985 | Levy |
| 4,497,538 | A | 2/1985 | Patel |
| 4,509,821 | A | 4/1985 | Stenger |
| 4,618,213 | A | 10/1986 | Chen |
| 4,709,982 | A | 12/1987 | Corne et al. |

(Continued)

FOREIGN PATENT DOCUMENTS

GB 2460479 A 12/2009

OTHER PUBLICATIONS

International Search Report dated May 20, 2015 in corresponding International Patent Application No. PCT/US2015/016160.

*Primary Examiner* — David Walczak
*Assistant Examiner* — Joshua Wiljanen
(74) *Attorney, Agent, or Firm* — Seager, Tufte & Wickhem LLP

(57) ABSTRACT

Cosmetics packaging and applicators including a gel based tip are described. Gel applicators may or may not be provided with a through-hole. In various embodiments, the gel may be a stand-alone gel or may be encapsulated in a membrane. The gel applicator provides a soft feel and may have cooling effect as well. In some embodiments, the applicator is mounted to a platform or a hollow insert and coupled to a container housing the cosmetics product.

19 Claims, 13 Drawing Sheets

(56) References Cited

U.S. PATENT DOCUMENTS

| | | | | |
|---|---|---|---|---|
| 4,716,183 | A | 12/1987 | Gamarra et al. | |
| 4,833,193 | A | 5/1989 | Sieverding | |
| 4,942,270 | A | 7/1990 | Gamarra | |
| 5,149,736 | A | 9/1992 | Gamarra | |
| 5,153,254 | A | 10/1992 | Chen | |
| 5,239,273 | A | 8/1993 | Hedstrom et al. | |
| 5,262,468 | A | 11/1993 | Chen | |
| 5,331,036 | A | 7/1994 | Kang et al. | |
| 5,334,646 | A | 8/1994 | Chen | |
| 5,336,708 | A | 8/1994 | Chen | |
| 5,393,462 | A * | 2/1995 | Avery | A61F 7/02 252/71 |
| 5,475,890 | A | 12/1995 | Chen | |
| 5,508,334 | A | 4/1996 | Chen | |
| 5,994,450 | A | 11/1999 | Pearce | |
| 6,191,216 | B1 | 2/2001 | Ganster et al. | |
| 7,093,995 | B1 | 8/2006 | Chan | |
| 7,309,184 | B2 * | 12/2007 | Butcher | A45D 34/04 401/172 |
| 7,331,731 | B2 * | 2/2008 | Hohlbein | A46B 9/005 401/132 |
| 8,091,963 | B2 * | 1/2012 | Wyner | A41D 13/082 297/214 |
| 2004/0058163 | A1 | 3/2004 | Gansen et al. | |
| 2004/0102573 | A1 | 5/2004 | Stender et al. | |
| 2007/0061978 | A1 | 3/2007 | Losio | |
| 2007/0186951 | A1 * | 8/2007 | Gueret | A45D 34/00 132/320 |
| 2012/0257920 | A1 * | 10/2012 | Jimenez | A46B 11/0027 401/118 |
| 2012/0266910 | A1 * | 10/2012 | Tarling | A45D 34/04 132/318 |
| 2012/0305556 | A1 | 12/2012 | Murase et al. | |

* cited by examiner

GEL COSMETIC APPLICATOR

CROSS-REFERENCE TO RELATED APPLICATION

This application claims benefit of priority to U.S. Provisional Patent Application Ser. No. 61/944,521 filed Feb. 25, 2014, which is hereby incorporated by reference.

FIELD

This disclosure relates to cosmetics packaging. More particularly, this disclosure relates to cosmetics packaging such as applicators. Further, this disclosure relates to such applicators which comprise a gel material, as well as methods of making and using them.

BACKGROUND

Relatively recently, cooling metal tips have been employed on cosmetics packaging to impart a cooling sensation during product application. These products have been well received. Despite the success and advantages of such tips, they are hard and stiff. There is a need for a softer, gentler applicator with, or even without, thermal capabilities.

Figure 2:
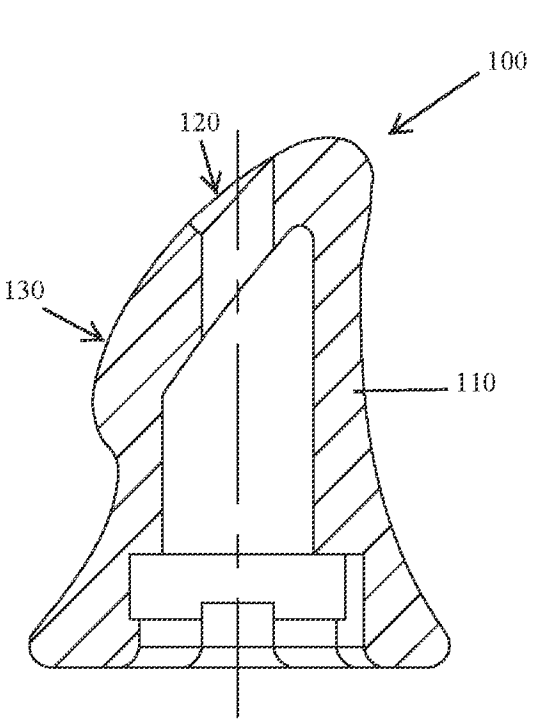
FIG. 2 is a cross-sectional view of a flow-through gel applicator tip, employing an outer coating or membrane on the outer surface of the gel in accordance with some embodiments.

These illustrations are meant to be exemplary only and are not intended to limit the scope of the invention. For example, each of the gel applicator types may be formed with or without the membrane or coating, as appropriate for the desired product characteristics, and other considerations.

DETAILED DESCRIPTION

Generally, disclosed herein is an applicator at least partially containing a gel or cosmetics packaging including such an applicator. The gel, in some embodiments, is capable of delivering a sensation of coolness, at ambient temperatures, without the need for refrigeration or outside cooling, although those could be used to enhance or prolong the effect.

Gel technology is currently employed in a number of areas, most notably in the bedding industry and shoe inserts where the gel often provides not only comfort, but often a cooling sensation. In the bedding industry, gel technology is used in or on pillows, mattresses, mattress pads, and the like.

Any suitable gel technology may be employed. The gel is generally a polymer composition which exhibits both liquid and solid characteristics, depending upon the particular composition, that is, the gel can range from a semi-liquid to a semi-solid. In some aspects, the gel composition may contain a three-dimensional network of cross-linked molecular chains (gels), or it may merely behave as if it contained such a network (gelloids). In some instances, the gel may be encased by a coating, membrane, or shell, or be capable of standing alone or combinations of such materials. When a coating, membrane, or shell is used, it can be a polymeric or other material capable of containing even semi-liquid gels, and providing resilient structure for the gel which permits a desired amount of deformation, while enough resiliency to return to its original shape. The gel may also include phase change materials which are useful in conveying the cooling sensation, since phase change materials, by definition absorb heat energy when changing phases. The gel of embodiments described in this document may be any liquid-extended polymer or a gelatinous composition having a molecular weight and hardness characteristics that allow the gel to deform yet have a resilience that allows it to rebound into its original shape quickly, such as within one second or less, when the load is removed. Examples of gels used in aspects of the invention include, without limitation, oil-extended triblock copolymer compositions such as that disclosed in U.S. Pat. No. 3,485,787, U.S. Pat. No. 3,676,387, U.S. Pat. No. 3,827,999, U.S. Pat. No. 4,176,240, U.S. Pat. No. 4,259,540, U.S. Pat. No. 4,351,913, U.S. Pat. No. 4,432,607, U.S. Pat. No. 4,492,428, U.S. Pat. No. 4,497,538, U.S. Pat. No. 4,509,821, U.S. Pat. No. 4,709,982, U.S. Pat. No. 4,716,183, U.S. Pat. No. 4,833,193, U.S. Pat. No. 4,942,270, U.S. Pat. No. 5,149,736, U.S. Pat. No. 5,331,036, and U.S. Pat. No. 5,994,450; and thermoplastic elastomer gelatinous compositions such as that disclosed in U.S. Pat. No. 4,369,284, U.S. Pat. No. 4,618,213, U.S. Pat. No. 5,262,468, U.S. Pat. No. 5,508,334, U.S. Pat. No. 5,153,254, U.S. Pat. No. 5,334,646, U.S. Pat.

No. 5,239,273, U.S. Pat. No. 5,475,890, and U.S. Pat. No. 5,336,708. Each of the above references is hereby incorporated by reference.

The gel can comprise any gel that is stable, non-toxic, and generally known to provide a cushioning effect while maintaining a degree of structural stability and support. In particular, the gel can comprise any gel material having a hardness and elasticity that are within a preferred range, as more fully described herein.

Polyurethane gels are particularly useful. Further, other gels that are resistant to hardening over time, have limited expandability, and are resistant to substance degradation (e.g., from migration of volatile agents, such as plasticizers) could also be useful as the gel in the present invention.

Examples of polyurethane gels capable of use according to the invention are disclosed in U.S. Pat. No. 6,191,216, United States Published Patent Application No. 2004/0058163 (application Ser. No. 10/618,558) and U.S. Published Patent Application No. 2004/0102573 (application Ser. No. 10/656,778), which are incorporated herein by reference. Examples of other types of gels useful according to the invention are disclosed in U.S. Pat. No. 4,404,296, U.S. Pat. No. 4,456,642, and U.S. Published Patent Application No. 2007/0061978 (application Ser. No. 11/365,473), which are incorporated herein by reference.

Any gel technology or combinations of such technologies may be used. In some embodiments, a gel material such as those available from Technogel are used. The Technogel materials are moldable, and deformable upon contact. These materials also convey a sensation of coolness, without requiring refrigeration or external cooling. Many suitable gel materials, including the Technogel material, provide a sensation of coolness when touched to the skin, and to the extent it eventually heats up during contact, returns to a cooling state when returned to ambient temperature. Until now, such materials have not been incorporated into cosmetics products, packaging, or applicators.

Unlike other materials such as metal, plastic, and even silicone, which have been used in cosmetics applicators previously, the gel material wipes product onto the skin much like a fingertip. The other materials tend to push product around rather than distribute it evenly. When product is applied to the skin using the gel material, the result is a smooth, even finish on the skin. The concept is difficult to quantify, but the softness, deformability, and resiliency of the gel more closely resemble the feeling, texture, resiliency, and other characteristics of a human finger. Thus making the applicator feel like an extension of your hand, rather than an outside object, and allowing for a more precise, controlled application of product. The gel material can be configured to have any desired surface texture. In some embodiments, the gel material, and its outer membrane if present, is designed to allow for proper application of product, but substantially will not absorb or adsorb the product to allow the gel applicator to be wiped, washed, or otherwise cleaned of excess product to be ready for a subsequent use. The lack of absorption or adsorption means less wasted product and the ability to clean the applicator means less chance for bacterial growth or contamination of fresh product with old product left. For example, sponge, cloth, or flocked applicators absorb relatively large amounts of product in their pores and between fibres resulting in staining of the applicator and retention of product within the applicator, which can reduce the ability of the applicator to effectively apply product, harbor bacteria, contaminate freshly applied product with old (possibly degraded) product, or simply require a new applicator before each use.

The gel may also be incorporated or encapsulated in other materials useful in cosmetics applicators, such as plastics, metals, foams, fibers, brushes, doefoot applicators, flocking material, sponges, and the like. Alternatively, a gel material may itself encapsulate additional materials. These additional materials can be used to modify the aesthetics or the functionality (or both) of the gel material. For example, embedding metal particles such as beads can provide an interesting visual and textural effect, and may improve the cooling effect.

The gel material may be used to replace or in conjunction with materials used in traditional cosmetics applicators, particularly for applying cosmetics; cosmetic preparations; skin care preparations for face and body, namely, medicated cleansers, non-medicated cleansers, toners, moisturizers, creams, lotions, oils, serums, masks, sunscreens, sun protectors, exfoliants, and skin reactivators, lighteners and regenerators; self-tanning preparations for face and body, namely, self-tanning creams, lotions, sprays, wipes, roll-ons; cosmetic and make-up preparations, namely, eye and lip sticks and liners, eye and lip repairers, eye and lip balms, eye and lip glosses, eye and lip creams, concealers, mascara, primers, foundation, blushes, bronzers, shadows, and makeup removers; non-medicated acne treatment preparations; hair care preparations, namely, hair shampoo, hair conditioner, hair cream; hair coloring preparations; cosmetic hair creams for concealing bald or thinning spots on scalp; non-medicated hair creams for hair growth; nail care preparations, namely, nail polishes, nail enamels, nail varnishes, nail hardeners, nail polish base coats, nail polish top coats, and nail polish removers; perfumes; eau de perfume; eau de toilette; fragrances, and the like.

Cosmetics applicators fall into two broad categories, flow-through applicators and non-flow-through applicators. Flow-through applicators are useful with tubes, bottles, airless pumps, click pens, and other types of packaging. These types of applicators are well-suited for eye gel and cream, lipgloss, liquid foundation, acne treatment, and the like. Non-flow-through applicators are useful as stand-alone applicators, with a handle, without a handle, in a bottle/wand configuration, and the like. These types of applicators are well-suited for mascara, lipgloss, eyeshadow, eye liner, and the like.

Figure 1:
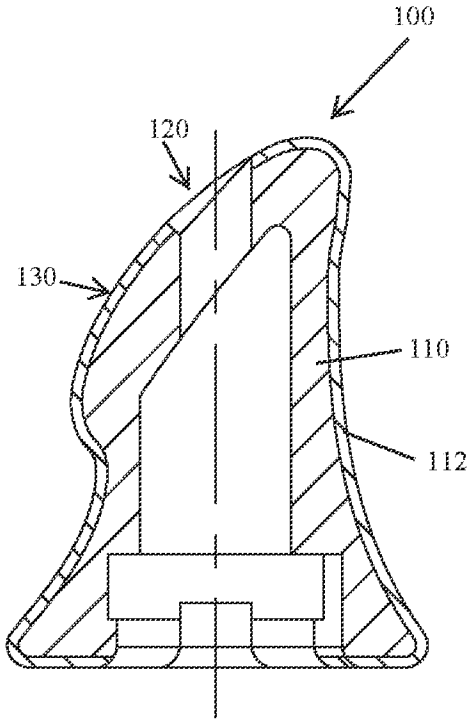
FIG. 1 is a cross-sectional view of a flow-through gel applicator tip in accordance with some embodiments.

In some embodiments, the applicator is a flow-through style applicator 100, such as shown in FIGS. 1 and 2, which incorporates a gel applicator body 110 which defines a through hole 120 from one portion to another. The through hole 120 defines a product pathway extending from a reservoir containing product at one end to the application surface 130 of the applicator 100 at the other. In some embodiments, the applicator may define more than one through hole (not shown). In some embodiments, such as shown in FIGS. 4, 5, 6, and 7, a hollow insert 200, such as a plastic insert, may be disposed within the through hole 120, and connected at one end to the reservoir housing. The insert 200 defines at least a portion of the product pathway, and is in fluid communication with the reservoir and the through hole 120 of the applicator. In some embodiments, the applicator 100 is removable from the insert 200, in others, it may be permanently affixed (that is, not intended to be removed by the user). The gel may be affixed to the insert by co-molding, friction fit, snap fit, and/or secured with adhesive. As seen in FIGS. 3A and 3B, the gel applicator 100 may be affixed co-molded or adhered to a platform 300 (note in FIGS. 3A-3D, there is no insert). In either embodiments, the insert 200 or platform 300 may continue to form a coupler 400 for attaching the applicator 100 to the container 500 which defines the reservoir containing the product. In some instances, the coupler 400 may be co-molded (or otherwise integrally formed) with the container 500, friction fit, snap fit, threaded, and/or secured with adhesive to the container 500.

In some embodiments, the use of gel material will convey a softness not previously achieved with metal or plastic applicators. In some embodiments, the gel material is about 50 on a Shore OOO scale. Some embodiments measure less than about 10 on a Shore OOO scale. Other embodiments measure less than 1 on a Shore OOO scale. The Shore OOO scale is used for materials which fall below the Shore A scale more typically used to measure the hardness of softer plastics. In some embodiments, applicators made from the gel material will have a hardness measured on a Shore OOO scale of about 0.1 to about 100, from about 50 to about 90, from about 30 to about 60, from about 10 to about 30, from about 0.1 to about 10, from about 0.1 to about 1, or from about 1 to about 10. Specifically, the gel may have a hardness measured on the Shore OOO scale of about 0.1, about 1, about 10, about 30, about 50, about 60, about 90, about 100, or any value or range of values between any two of these, including end points.

Various constructions may be used to achieve desired properties for any particular applicator. For example, some embodiments, can include an all-gel applicator available in different hardnesses or including sections of varying hardness in the same applicator. For example, an applicator in a tip form could be made relatively soft at the application surface, but substantially harder to interface with a container or reservoir housing. Some embodiments could employ a combination of gel and traditional plastics, molded or assembled together. For example, a gel applicator could be permanently bonded to an insert which is in turn affixed (permanently or removable) to a container. In some embodiments, the insert could be integral with the container (particularly in the case of a tube). In some embodiments, a gel applicator tip can be provided with a through hole of suitable size for dispensing product at its application surface, and where the through hole shape and diameter is also adapted to friction (or otherwise) fit onto an insert. Notches, cut-outs, or other features may be provided to enhance the fit or locking nature of the tip.

In some embodiments, the through hole in the gel applicator may be formed partially. For example, the through hole could be formed only a portion of the way, and then punctured by insertion of the applicator onto the container (or an insert thereon). This could be done either by the cosmetics user or at an assembly plant. In another embodiment, the gel applicator could be punctured by a point inside a cap placed over the applicator. Again, this could be done by the end user or in an assembly plant. If performed by the end user, the end user is assured that the product is safe, fresh, and unopened until they themselves puncture the applicator. The point in the cap also would serve the function of sealing the applicator after each use, preserving the useful life of the product.

Turning now to the Figures for reference, FIG. 1 shows a cross-sectional view of an applicator in accordance with some embodiments. The applicator 100, defines a through hole 120 which in turn at least partially defines a product pathway. As shown in FIG. 1, a gel body 110 is provided and encapsulated by a membrane 112, as described above. An application surface 130 is formed by the outer surface of the applicator 100. As depicted in FIG. 1, the through hole can be shaped and sized to accept a hollow insert (shown in later figures). FIG. 2 depicts a similar applicator, without the encapsulating membrane. Throughout the figures, both membrane and membrane-less embodiments are shown.

Figure 3D:
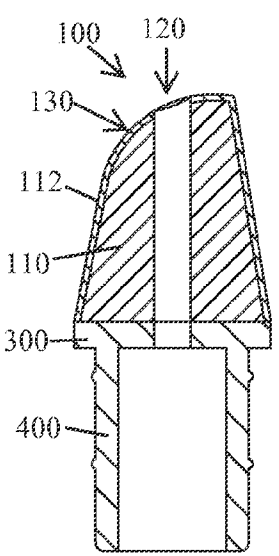
FIG. 3D depicts a cross-sectional view of a flow-through gel applicator tip having a gel tip affixed to coupling platform and a membrane/coating on the outer surface of the gel, in accordance with some embodiments.
Figure 3C:
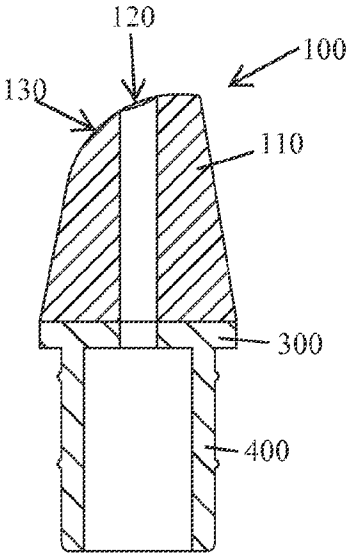
FIG. 3C depicts a cross-section view of a flow-through gel applicator tip having a gel tip affixed to a coupling platform without a membrane/coating on the outer surface of the gel in accordance with some embodiments.
Figure 3B:
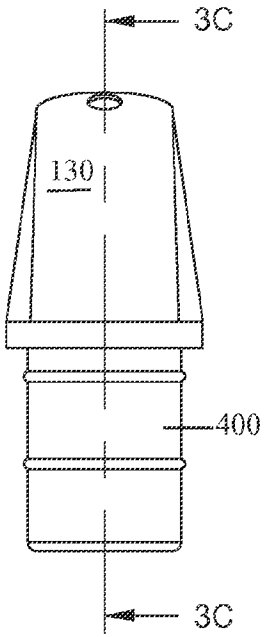
FIG. 3B depicts a front view of a tip in accordance with some embodiments.
Figure 3A:
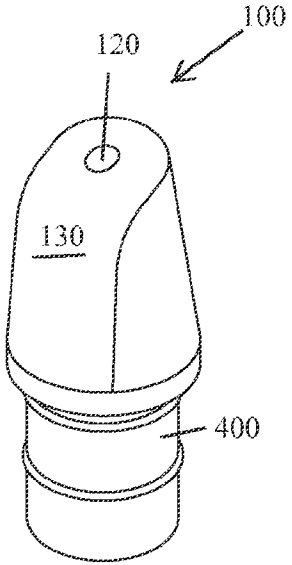
FIG. 3A depicts a perspective view of a tip in accordance with some embodiments.
Figure 4C:
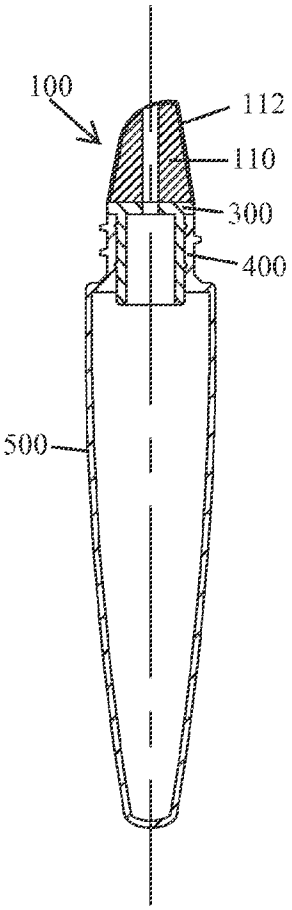
FIGS. 4A-4C depict several views of an exemplary flow-through gel applicator tip, showing a membrane/coating as well as an insert used to affix the applicator to the container in accordance with some embodiments.
Figure 4B:
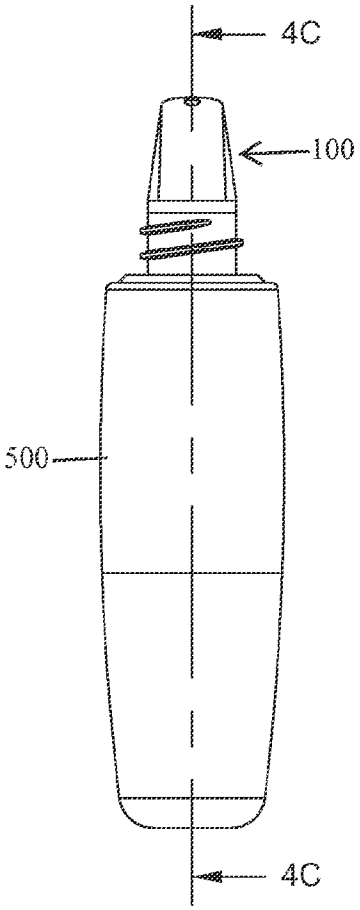
Figure 4A:
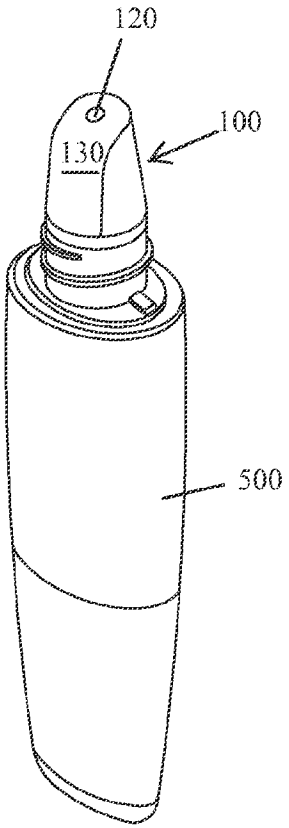

FIGS. 3A-3D show alternative embodiments. FIGS. 3A and 3B depict external views of an applicator 100 as described herein. FIG. 3C depicts an applicator 100, having a membraneless gel body 110 defining a through hole 120, which is affixed to a platform 300, which is integrally made with a coupler 400 for coupling to a container (not shown). FIG. 3D is a similar cross-section view of an embodiment having a membrane 112. FIGS. 4A-4C depict an applicator 100 similar to those of FIGS. 3A-3D on a container 500, here a tottle, although the container need not be so limited.

Figure 5C:
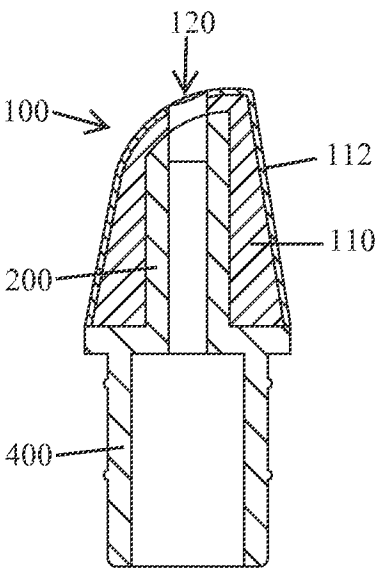
FIGS. 5A-5F depict several views of a flow-through gel applicator tip with an insert, adapted for a frictional and/or adhesive fit, and container, in accordance with some embodiments.
Figure 5B:
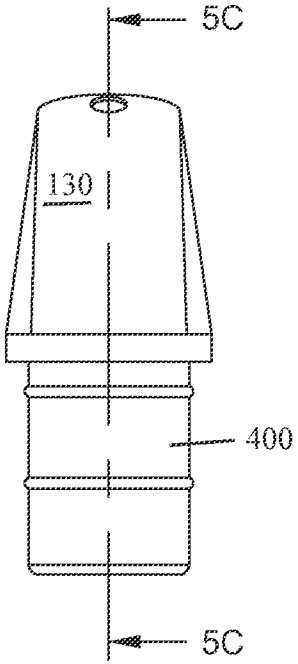
Figure 5A:
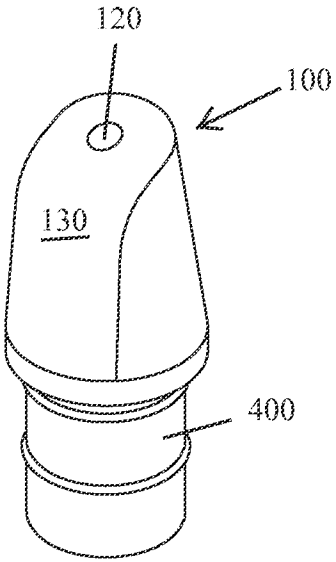
Figure 5F:
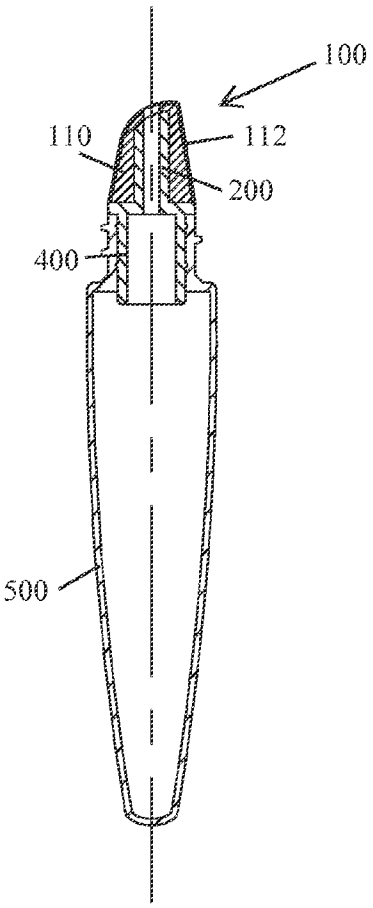
Figure 5E:
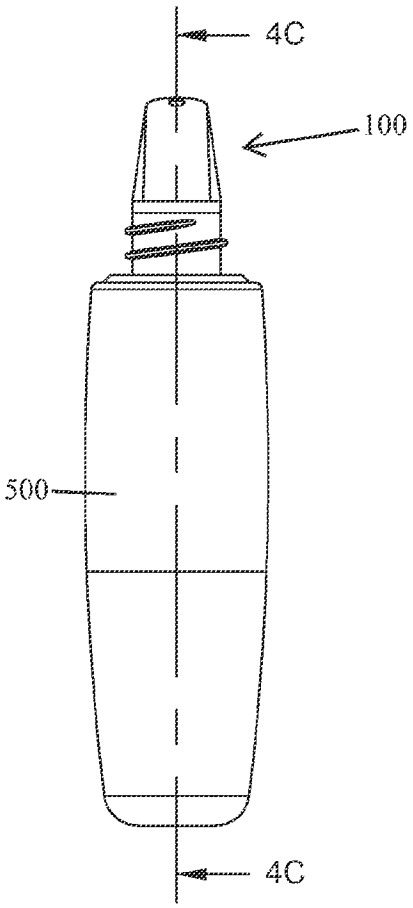
Figure 5D:
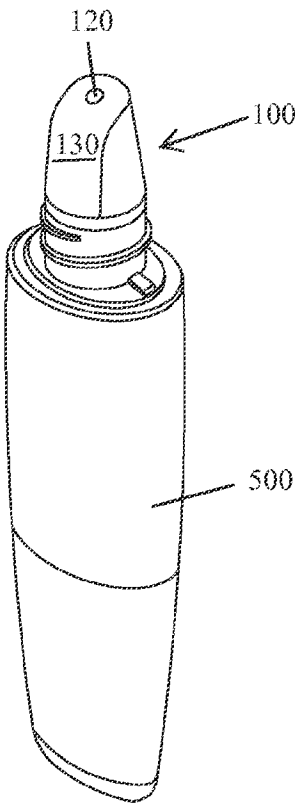

FIGS. 5A-5C show other alternative embodiments. FIGS. 5A and 5B depict external views of an applicator 100 as described herein. FIG. 5C is a cross-sectional view depicting an applicator 100, having a gel body 110 defining a through hole 110, in FIG. 5C, a membrane 112 is depicted, although membraneless gel body may also be used. The applicator 100 is affixed to a hollow insert 200, which is integrally made with a coupler 400 for coupling to a container (not shown). FIGS. 5D-5F depict an applicator 100 similar to those of FIGS. 5A-5C on a container 500, here a tottle, although the container need not be so limited.

FIGS. 5A-5F show other alternative embodiments. FIGS. 5A and 5B depict external views of an applicator 100 as described herein. FIG. 5C is a cross-sectional view depicting an applicator 100, having a gel body 110 defining a through hole 120, in FIG. 5C, a membrane 112 is depicted, although membraneless gel body may also be used. The applicator 100 is affixed to a hollow insert 200, which is integrally made with a coupler 400 for coupling to a container (not shown). FIGS. 5D-5F depict an applicator 100 similar to those of FIGS. 5A-5C on a container 500, here a tottle, although the container need not be so limited.

Figure 6C:
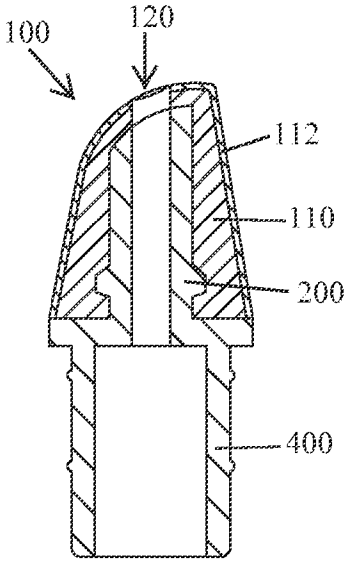
FIGS. 6A-6F depict several views of a flow-through gel applicator tip with an insert, adapted for co-molding, snap-in and/or adhesive fit, and a container, in accordance with some embodiments.
Figure 6B:
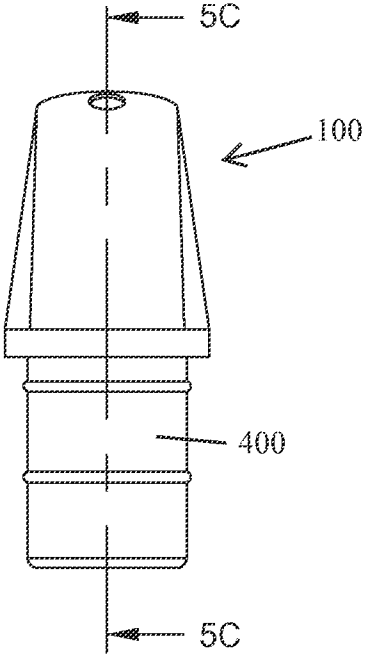
Figure 6A:
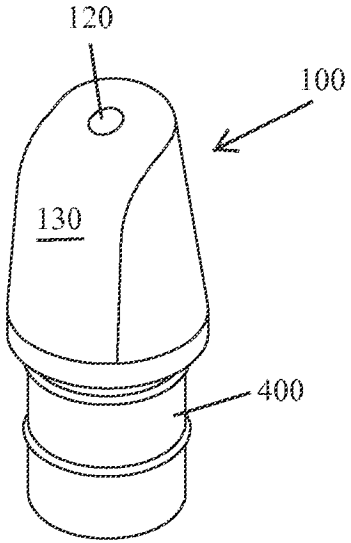
Figure 6F:
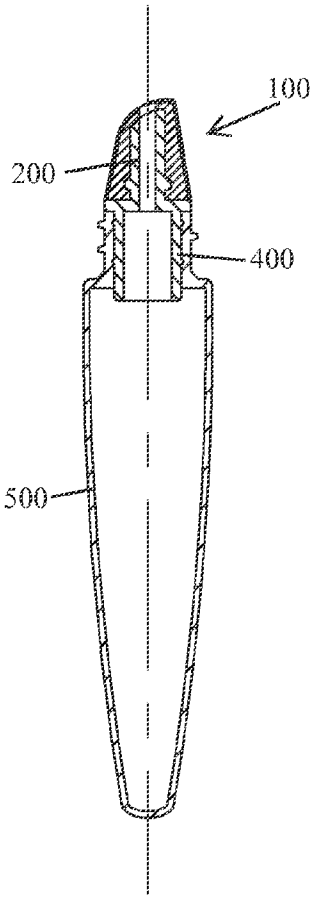
Figure 6E:
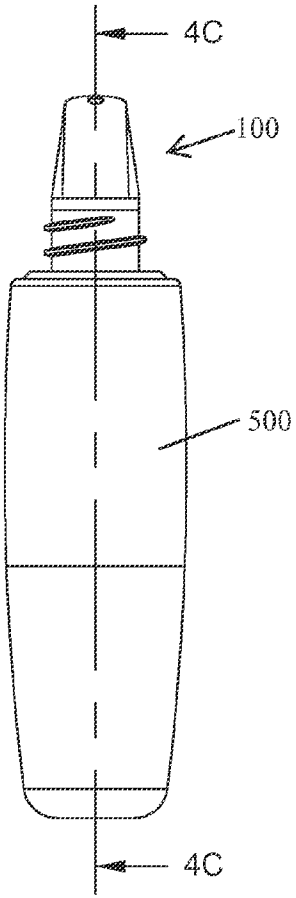
Figure 6D:
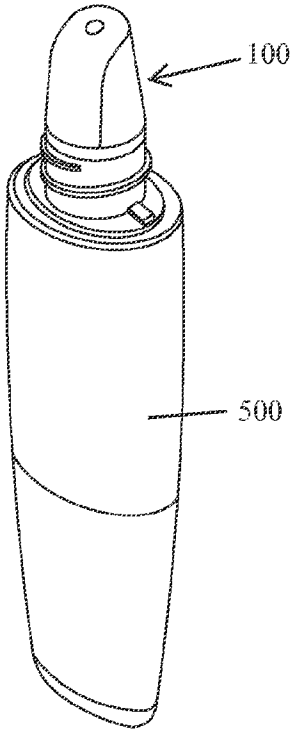

FIGS. 6A-6F show other alternative embodiments. FIGS. 6A and 6B depict external views of an applicator 100 as described herein. FIG. 6C is a cross-sectional view depicting an applicator 100, having a gel body 110 defining a through hole 120, in FIG. 5C, a membrane 112 is depicted, although membraneless gel body may also be used. The applicator 100 is affixed to a hollow insert 200, which is integrally made with a coupler 400 for coupling to a container (not shown). As shown in FIG. 6C, the hollow insert 200 may be provided with one or more protrusion, rings, barbs, or the like to allow for snap fit, friction fit, or to allow increased surface area for affixing the applicator 100 to the hollow insert 200. FIGS. 6D-6F depict an applicator 100 similar to those of FIGS. 6A-6C on a container 500, here a tottle, although the container need not be so limited.

Figure 7C:
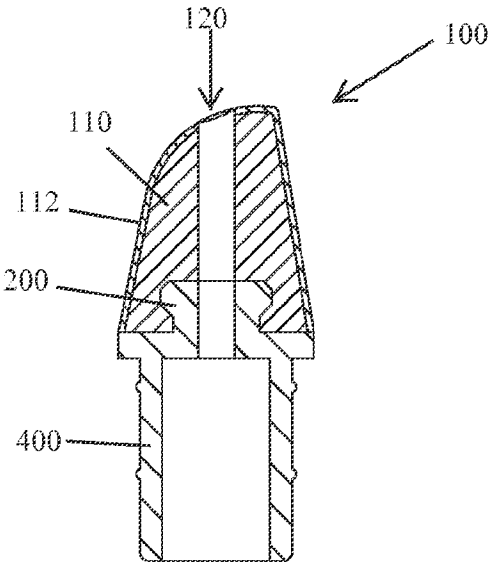
FIGS. 7A-7F depict several views of a flow-through gel applicator tip with an insert, adapted for co-molding, snap-in and/or adhesive fit, and container, in accordance with some embodiments.
Figure 7B:
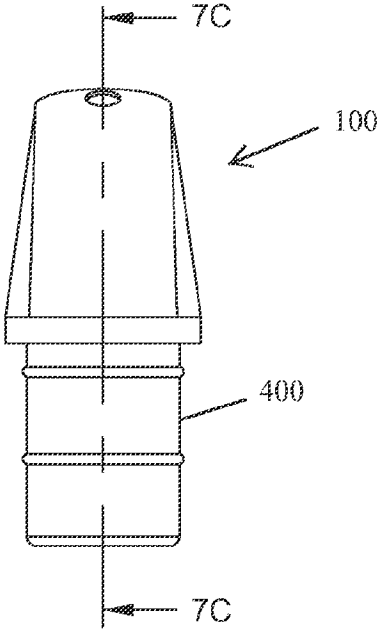
Figure 7A:
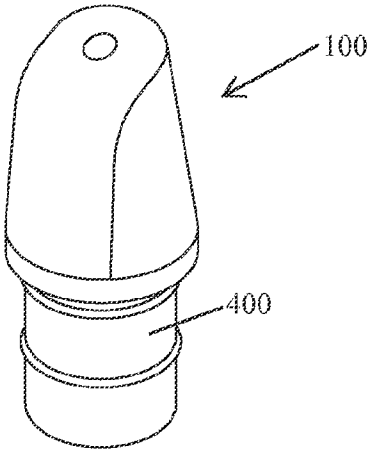
Figure 7F:
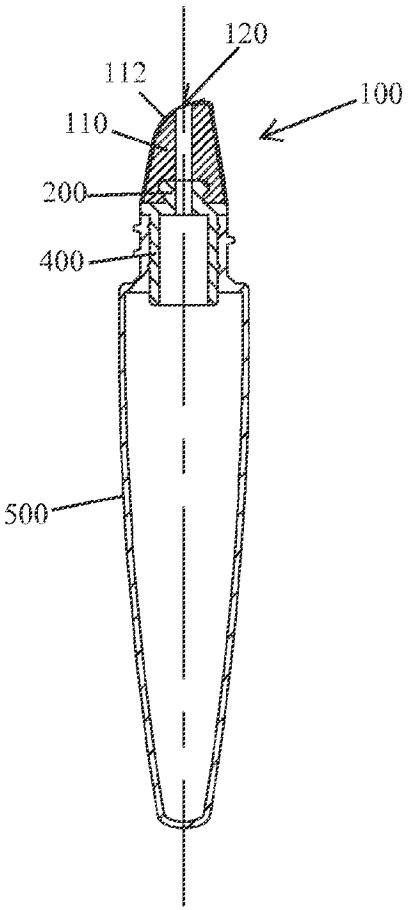
Figure 7E:
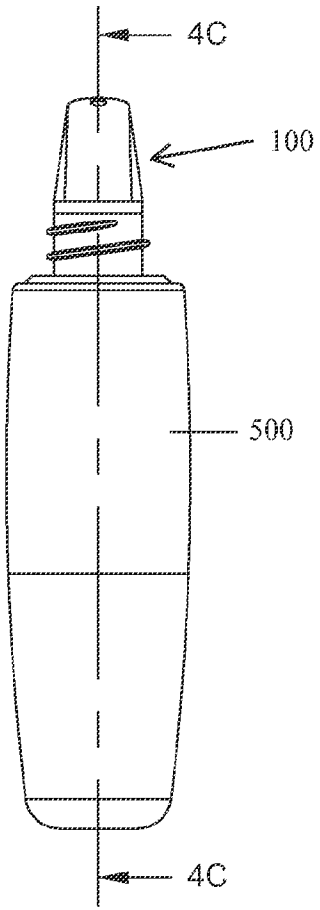
Figure 7D:
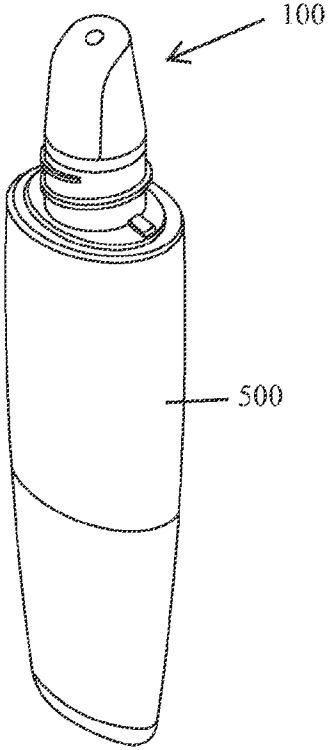

FIGS. 7A-7F show other alternative embodiments. FIGS. 7A and 7B depict external views of an applicator 100 as described herein. FIG. 7C is a cross-sectional view depicting an applicator 100, having a gel body 110 defining a through hole 120. In FIG. 5C, a membrane 112 is depicted, although membraneless gel body may also be used. The applicator 100 is affixed to a hollow insert 200, which is integrally made with a coupler 400 for coupling to a container (not shown). In this embodiment, the hollow insert 200 does not extend completely through the applicator 100 to the application surface 130. Rather, the hollow insert 200 occupies only a portion of the through hole 120 and together with the through hole 120 define the product pathway which emerges at the applicator surface 130. As shown in FIG. 7C, the hollow insert 200 is shaped and configured to allow for snap fit, friction fit, or to allow increased surface area for affixing the applicator 100 to the hollow insert 200. FIGS. 7D-7F depict an applicator 100 similar to those of FIGS. 7A-7C on a container 500, here a tottle, although the container need not be so limited.

Figure 8C:
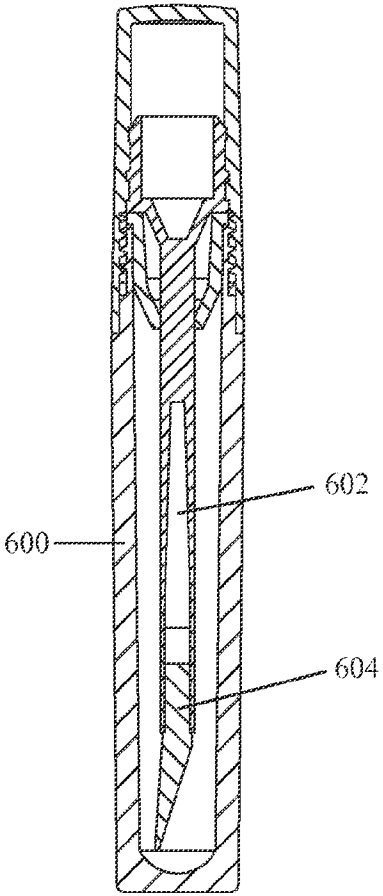
FIGS. 8A-8C depict several views of a gel applicator in a wand configuration in accordance with some embodiments.
Figure 8B:
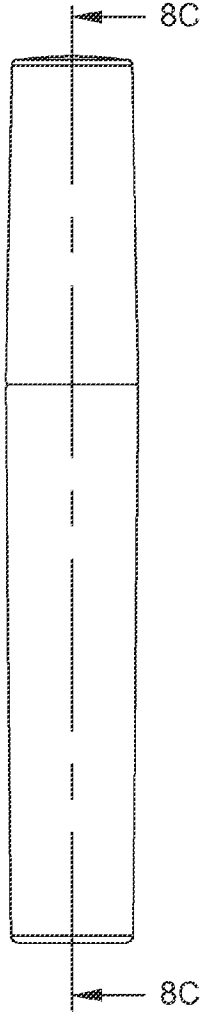
Figure 8A:
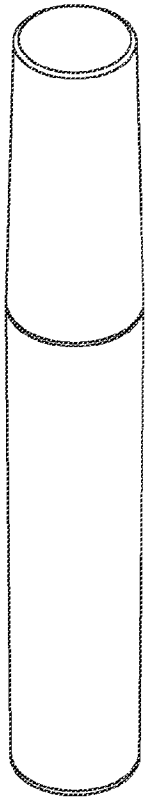
Figure 9D:
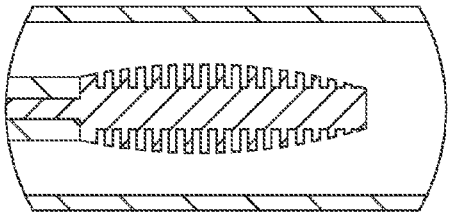
FIGS. 9A-9D depict several views of a gel applicator in a wand/brush configuration in accordance with some embodiments.
Figure 9C:
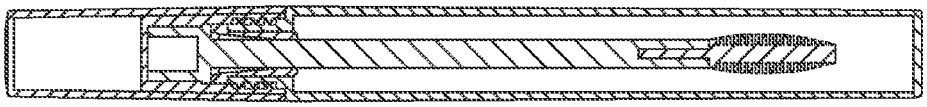
Figure 9B:
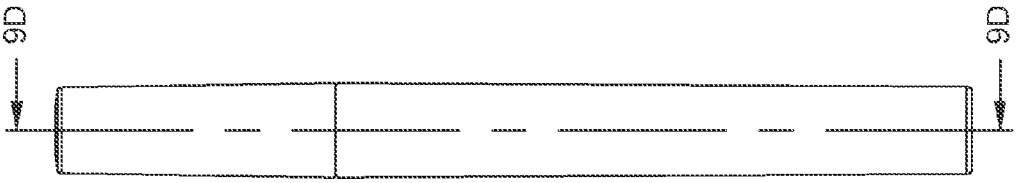
Figure 9A:
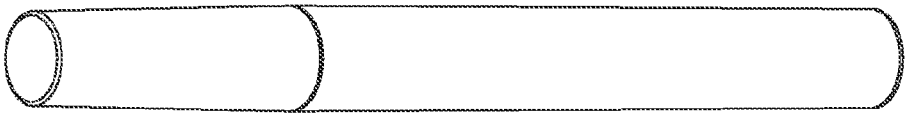

FIGS. 8A-8C depict yet another embodiment. The embodiment shown is not a flow-through applicator as described above. It should be noted that any of the above described applicators could be made without the through hole, in which case each would be an applicator and not a dispensing applicator.

FIGS. 8A and 8B depict the exterior of a cosmetic product such as lip gloss. In this instance, a container 600 is provided for housing the product. A stemmed applicator 602 is provided with a gel applicator 604. As is common with lip glosses, the stemmed applicator 602 is affixed to a cap which is used to seal the container. The gel applicator 604 as shown in FIG. 8C is a membraneless gel, but could also be a membraned applicator as described above.

Figure 10C:
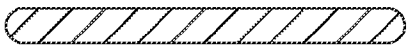
FIGS. 10A-10C depict several views of a gel applicator in the form of a pad, sponge, or similar applicator device.
Figure 10B:
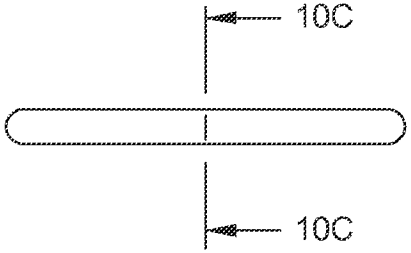
Figure 10A:
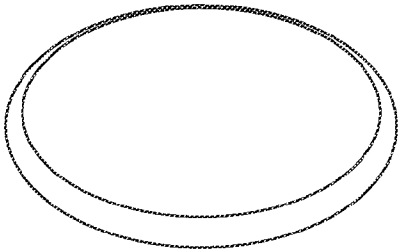
Figure 11C:
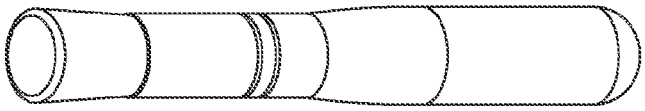
FIGS. 11A-11C depict several views of a gel applicator having a handle.
Figure 11B:
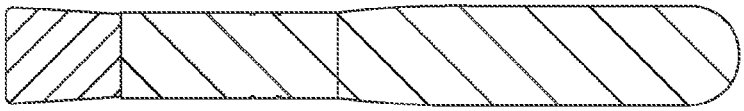
Figure 11A:
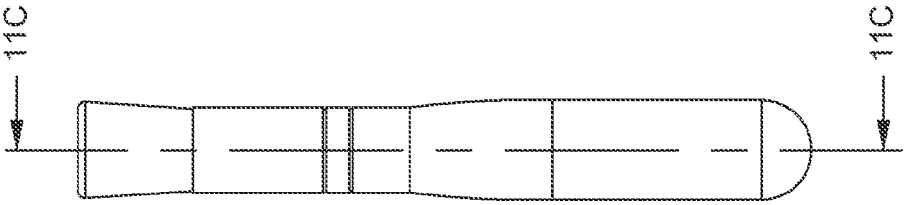

FIGS. 9-11 depict other alternative applicators for different types of cosmetics products. FIGS. 9A-9D show a similar arrangement, wherein the gel applicator is a mascara brush 604*a*. FIGS. 10A-10C show a cosmetic pad 700 made from the gel material. FIGS. 11A-11C depict a brush-like applicator, where gel material is used in place of the bristles. As with the other embodiments, although a membraneless embodiment is shown, membrane gels may also be used.

Construction for the non-flow-through versions can be made in similar combinations to achieve the desired properties of the applicator. These applicators may be additionally provided with a handle, wand, or other features. Through development of appropriate molds and molding techniques, almost any traditional cosmetic applicator could be replaced entirely or partially with cooling gel material to impart the benefits of a cooling sensation while applying cosmetics products.

Particularly contemplated are sponge-like applicators made at least partially from the gel material. In some embodiments, the gel may be formed as a foam system incorporating a plurality of voids to simulate a sponge material. Unlike a traditional sponge, the gel material does not absorb substantial amounts of the product placed on the applicator, but rather allows the product to sit on the surface of the applicator until it is applied to the skin. As a result, the user may achieve the same cosmetic effect using a lesser quantity of the cosmetic product, and the applicator is easily cleaned and reused. Any product that happens to remain in a pore of the sponge-like gel, can easily be rinsed or cleaned away, and therefore limit any discoloration of the applicator and minimize retention of used product.

In some embodiments, a more traditional foam or sponge material may be impregnated with or encapsulate gel material, for example, in the form of beads. In this manner, traditional sponge-like effects (for example, ability to hold water or product) are maintained with the benefits of the cooling gel.

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

The following terms shall have, for the purposes of this application, the respective meanings set forth below.

"Optional" or "optionally" means that the subsequently described event or circumstance may or may not occur, and that the description includes instances where the event occurs and instances where it does not.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, et cetera. As a non-limiting example, each range discussed herein can be readily broken down into a lower third, middle third and upper third, et cetera. As will also be understood by one skilled in the art all language such as "up to," "at least," and the like include the number recited and refer to ranges which can be subsequently broken down into subranges as discussed above. Finally, as will be understood by one skilled in the art, a range includes each individual member.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

Although the present invention has been described in considerable detail with reference to certain preferred embodiments thereof, other versions are possible. Therefore, the spirit and scope of the appended claims should not be limited to the description and the preferred versions contained within this specification.

What is claimed is:

1. A cosmetic applicator comprising:

an applicator body formed from a first material encapsulated by a second material, wherein the first material is a gel material, the applicator body defining an application surface for applying cosmetics, the applicator body defining a through hole, wherein the gel material defines the through hole such that cosmetics moving through the through hole are in direct contact with the gel material.

2. The cosmetic applicator of claim 1, wherein the applicator defines an end adapted for coupling to a product reservoir, and the through hole fluidly connects the application surface to the product reservoir.

3. The cosmetic applicator of claim 2, wherein the product reservoir is defined by a bottle, tottle, tube, container, or click pen.

4. The cosmetic applicator of claim 1, wherein the applicator simulates a sponge.

5. The cosmetic applicator of claim 1, wherein the second material is thermoplastic, metal, foam, or a gel of different hardness than the first material.

6. The cosmetic applicator of claim 1, wherein the applicator is incorporated as part of cosmetics packaging for applying cosmetics;

the gel material may be used to replace or in conjunction with materials used in traditional cosmetics applicators, particularly for applying cosmetics; cosmetic preparations; skin care preparations for face and body, namely, non-medicated cleansers, toners, moisturizers, creams, lotions, oils, serums, masks, sunscreens, sun protectors, exfoliants, and skin reactivators, lighteners and regenerators; self-tanning preparations for face and body, namely, self-tanning creams, lotions, sprays, wipes, roll-ons; cosmetic and make-up preparations, namely, eye and lip sticks, eye and lip repairers, eye and lip balms, eye and lip glosses, eye and lip creams, concealers, mascara, primers, foundation, blushes, bronzers, shadows, and makeup removers; non-medicated acne treatment preparations; hair care preparations, namely, hair shampoo, hair conditioner, hair cream; hair coloring preparations; cosmetic hair creams for concealing bald or thinning spots on scalp; non-medicated hair creams for hair growth; nail care preparations, namely, nail polishes, nail enamels, nail varnishes, nail hardeners, nail polish base coats, nail polish top coats, and nail polish removers; perfumes; eau de perfume; eau de toilette; fragrances, and the like, and combinations thereof.

7. The cosmetics applicator of claim 1, wherein the applicator is a flow-through applicator.

8. A cosmetics packaging comprising the applicator of claim 1.

9. The cosmetics packaging of claim 8 further comprising one of a bottle, tottle, tube, container, or click pen.

10. The cosmetic applicator of claim 1, wherein the second material is a membrane.

11. The cosmetic applicator of claim 1, further comprising an insert disposed within the applicator body, wherein the insert defines a portion of the through hole.

12. The cosmetic applicator of claim 11, wherein the insert includes a protrusion extending radially into the gel material.

13. A cosmetic applicator comprising:

an applicator body formed from a first material encapsulated by a second material, wherein the first material is a gel material, the applicator body defining an application surface for applying cosmetics, the applicator body defining a through hole, wherein the gel material has a hardness of 90 or less on a Shore OOO scale.

14. The cosmetic applicator of claim 13, wherein the gel material has a hardness of 10 or less on the Shore OOO scale.

15. The cosmetic applicator of claim 14, wherein the gel material has a hardness 1 or less on the Shore OOO scale.

16. A cosmetic applicator comprising:

an applicator body formed from a gel material having a hardness of 90 or less on a Shore OOO scale, the applicator body defining an application surface for applying cosmetics, the gel material of the applicator body defining a through hole fluidly connecting the application surface to a product reservoir.

17. The cosmetic applicator of claim 16, wherein the gel material is encapsulated by a second material different from the gel material.

18. The cosmetic applicator of claim 16, wherein the applicator defines an end adapted for coupling to a product reservoir.

19. The cosmetic applicator of claim 16, wherein the gel material has a hardness of 10 or less on the Shore OOO scale.

* * * * *